US006831232B2

(12) United States Patent
Henricks et al.

(10) Patent No.: US 6,831,232 B2
(45) Date of Patent: Dec. 14, 2004

(54) COMPOSITE INSULATOR

(76) Inventors: Scott Henricks, 2790 Fawn Trail, Prairie Grove, IL (US) 60012; Michael J. Schomer, 1437 S. Fern, Mount Prospect, IL (US) 60056; Victor Almgren, 3833 N. Wilton Ave. #2N, Chicago, IL (US) 60613

( * ) Notice: Subject to any disclaimer, the term of this patent is extended or adjusted under 35 U.S.C. 154(b) by 163 days.

(21) Appl. No.: 10/173,387

(22) Filed: Jun. 16, 2002

(65) Prior Publication Data

US 2004/0001298 A1 Jan. 1, 2004

(51) Int. Cl.[7] ..... H01B 17/38
(52) U.S. Cl. ..... 174/142; 174/176; 174/179
(58) Field of Search ..... 174/138 R, 140 H, 174/140 S, 141 C, 142, 152 GM, 152 R, 176–179, 193, 195–197, 209, 212

(56) References Cited

U.S. PATENT DOCUMENTS

| | | | | |
|---|---|---|---|---|
| 706,194 | A | 5/1902 | McCarthy | |
| 735,611 | A | 1/1903 | Steinberger | |
| 1,029,207 | A | 6/1912 | Megahan | |
| 1,038,473 | A | 9/1912 | Alsberg | |
| 1,116,303 | A | 11/1914 | Locke | |
| 1,167,125 | A | 1/1916 | Sloper | |
| 1,170,723 | A | 2/1916 | Allerding | |
| 1,516,585 | A | 11/1924 | Austin | |
| 1,691,330 | A | 11/1928 | Austin | |
| 1,717,287 | A | 6/1929 | Warren et al. | |
| 1,730,327 | A | 10/1929 | Kempton | |
| 1,730,716 | A | 10/1929 | Austin | |
| 1,764,419 | A * | 6/1930 | Schramm | 174/158 R |
| 1,768,948 | A | 7/1930 | Baum | |
| 1,865,134 | A | 6/1932 | Plimpton | |
| 1,869,397 | A | 8/1932 | Stroup | |
| 1,894,292 | A | 1/1933 | Cramer | |
| 1,896,740 | A | 2/1933 | Cosseboom | |
| 1,942,294 | A | 1/1934 | Kaufmann | |
| 1,967,654 | A | 7/1934 | Austin | |
| 1,980,476 | A | 11/1934 | Earle | |
| 2,017,519 | A | 10/1935 | Waldron | |
| 2,049,552 | A | 8/1936 | Walsh | |
| 2,155,848 | A | 4/1939 | Taylor | |
| 2,174,476 | A | 9/1939 | Pittman et al. | |

(List continued on next page.)

FOREIGN PATENT DOCUMENTS

| | | |
|---|---|---|
| CH | 659 907 A5 | 2/1987 |
| EP | 0 510 397 B1 | 7/1995 |
| EP | 0 709 862 A1 | 5/1996 |

OTHER PUBLICATIONS

S&C Fuse Cutouts—Type XS, Oct. 29, 2001, 1 page.
MacLean Molded Products, Inc., Quoatation No. 109–470, Aug. 8, 2001, 2 pages.
MacLean Molded Products, Inc., Quoatation No. 109–471, Aug. 8, 2001, 2 pages.
MacLean Molded Products, Inc., Quoatation No. 109–472, Aug. 8, 2001, 2 pages.
Cutout Insulators Capacity and Scheduling Estimates for 2002, Victor Almgren, Jun. 12, 2002, 1 page.

(List continued on next page.)

*Primary Examiner*—Chau N. Nguyen
*Assistant Examiner*—Adolfo Nino

(57) ABSTRACT

The present invention relates to a composite insulator comprising: (i) a composite body having at least two connectors, wherein the composite body is coupled to a conductor; and (ii) a housing, wherein the housing is a one-piece housing and the composite body is located inside the housing.

53 Claims, 9 Drawing Sheets

U.S. PATENT DOCUMENTS

| | | | | | |
|---|---|---|---|---|---|
| 2,221,582 | A | | 11/1940 | Hanna | |
| 2,246,193 | A | | 6/1941 | Smith, Jr. | |
| 2,378,109 | A | | 6/1945 | Schultz | |
| 2,386,112 | A | | 10/1945 | Harkins | |
| 2,593,426 | A | | 4/1952 | Fahnoe | |
| 2,606,954 | A | | 8/1952 | Baker | |
| 2,625,498 | A | | 1/1953 | Koch | |
| 2,653,884 | A | | 9/1953 | Hussey et al. | |
| 2,660,644 | A | | 11/1953 | Murray et al. | |
| 2,723,705 | A | | 11/1955 | Collins | |
| 2,732,423 | A | | 1/1956 | Morrison | |
| 2,741,294 | A | | 4/1956 | Pancherz | |
| 2,744,043 | A | | 5/1956 | Ramberg | |
| 2,747,616 | A | | 5/1956 | Ganahl | |
| 2,776,332 | A | | 1/1957 | Von Cron | |
| 2,789,154 | A | | 4/1957 | Peterson | |
| 2,821,604 | A | | 1/1958 | Wallace | |
| 2,848,133 | A | | 8/1958 | Ramberg | |
| 2,858,992 | A | | 11/1958 | Wentz | |
| 2,883,448 | A | | 4/1959 | Hermann | |
| 2,900,292 | A | | 8/1959 | Coleman, Jr. | |
| 2,905,582 | A | | 9/1959 | Coleman, Jr. | |
| 2,924,643 | A | | 2/1960 | Barnes | |
| 2,961,518 | A | | 11/1960 | Hermann | |
| 2,997,529 | A | | 8/1961 | Fink | |
| 3,043,120 | A | | 7/1962 | Waldron | |
| 3,057,509 | A | | 10/1962 | Bernd | |
| 3,063,891 | A | | 11/1962 | Boylan et al. | |
| 3,066,180 | A | | 11/1962 | Virsberg | |
| 3,068,133 | A | | 12/1962 | Cilker et al. | |
| 3,076,053 | A | * | 1/1963 | Moussou | 174/179 |
| 3,110,758 | A | | 11/1963 | Meier | |
| 3,110,759 | A | * | 11/1963 | Moussou | 174/182 |
| 3,111,451 | A | | 11/1963 | Peters | |
| 3,116,386 | A | | 12/1963 | Sperzel | |
| 3,134,164 | A | | 5/1964 | Hocks | |
| 3,134,874 | A | | 5/1964 | Cameron | |
| 3,152,392 | A | | 10/1964 | Coppack et al. | |
| 3,159,709 | A | | 12/1964 | Austin et al. | |
| D201,133 | S | | 5/1965 | Vose | |
| 3,192,622 | A | | 7/1965 | Bannerman | |
| 3,198,878 | A | | 8/1965 | Kaczerginski | |
| 3,218,517 | A | | 11/1965 | Sankey | |
| 3,235,688 | A | | 2/1966 | Fink et al. | |
| 3,249,719 | A | | 5/1966 | Misare et al. | |
| 3,260,796 | A | | 7/1966 | Hirtzer | |
| 3,261,910 | A | | 7/1966 | Jacquier | |
| 3,282,757 | A | | 11/1966 | Brussee | |
| 3,296,366 | A | | 1/1967 | Bronikowski | |
| 3,307,137 | A | | 2/1967 | Tordoff et al. | |
| 3,323,097 | A | | 5/1967 | Tordoff | |
| 3,325,584 | A | | 6/1967 | Herzig | |
| 3,345,483 | A | | 10/1967 | Leonard et al. | |
| 3,358,076 | A | | 12/1967 | Rebosio | |
| 3,363,174 | A | | 1/1968 | Hudson et al. | |
| 3,377,420 | A | | 4/1968 | Brown et al. | |
| 3,387,839 | A | | 6/1968 | Miller et al. | |
| 3,429,758 | A | | 2/1969 | Young | |
| 3,448,343 | A | | 6/1969 | Kershaw, Jr. | |
| 3,449,182 | A | | 6/1969 | Wiltshire | |
| 3,468,740 | A | | 9/1969 | Kaczerginski | |
| 3,470,051 | A | | 9/1969 | Meyer | |
| 3,485,940 | A | | 12/1969 | Perry et al. | |
| 3,506,833 | A | | 4/1970 | Von Willisen | |
| 3,509,267 | A | | 4/1970 | Jensen | |
| 3,512,118 | A | | 5/1970 | Leonard | |
| 3,513,425 | A | | 5/1970 | Arndt | |
| 3,522,366 | A | | 7/1970 | Lambeth | |
| 3,553,978 | A | | 1/1971 | Williams | |
| 3,567,541 | A | | 3/1971 | Kaczerginski | |
| 3,594,676 | A | | 7/1971 | Misare | |
| 3,611,240 | A | | 10/1971 | Mikulecky | |
| 3,645,899 | A | * | 2/1972 | Linson | 174/165 |
| 3,648,211 | A | | 3/1972 | McKeithan | |
| 3,666,589 | A | | 5/1972 | Alderfer | |
| 3,686,603 | A | | 8/1972 | Lockie et al. | |
| 3,686,604 | A | | 8/1972 | Link et al. | |
| 3,715,252 | A | | 2/1973 | Fairbairn | |
| 3,735,019 | A | | 5/1973 | Hess et al. | |
| 3,746,424 | A | | 7/1973 | Hermstein | |
| 3,784,235 | A | | 1/1974 | Kessler et al. | |
| 3,794,751 | A | | 2/1974 | Farmer et al. | |
| 3,802,989 | A | | 4/1974 | Huber et al. | |
| 3,808,352 | A | | 4/1974 | Johnson | |
| 3,810,060 | A | | 5/1974 | Hubbard | |
| 3,826,025 | A | | 7/1974 | Elliott | |
| 3,839,593 | A | | 10/1974 | Meier et al. | |
| 3,850,722 | A | | 11/1974 | Kreft | |
| 3,859,704 | A | | 1/1975 | Nasson | |
| 3,868,615 | A | | 2/1975 | Haubein et al. | |
| 3,898,372 | A | | 8/1975 | Kalb | |
| 3,952,848 | A | | 4/1976 | Walker et al. | |
| 3,979,554 | A | | 9/1976 | Fesik et al. | |
| 4,011,537 | A | | 3/1977 | Jackson, Jr. et al. | |
| 4,045,604 | A | | 8/1977 | Clabburn | |
| 4,053,707 | A | | 10/1977 | Ely et al. | |
| 4,198,538 | A | | 4/1980 | Lusk | |
| 4,212,696 | A | | 7/1980 | Lusk et al. | |
| 4,217,466 | A | | 8/1980 | Kuhl | |
| 4,246,696 | A | | 1/1981 | Bauer et al. | |
| 4,267,402 | A | | 5/1981 | Reighter | |
| 4,296,276 | A | | 10/1981 | Ishihara et al. | |
| 4,308,566 | A | | 12/1981 | Imataki et al. | |
| 4,316,204 | A | | 2/1982 | Inagaki et al. | |
| 4,331,833 | A | | 5/1982 | Pargamin et al. | |
| 4,343,966 | A | * | 8/1982 | Pargamin | 174/140 S |
| 4,373,113 | A | | 2/1983 | Winkler et al. | |
| 4,380,483 | A | | 4/1983 | Kliger | |
| 4,386,250 | A | | 5/1983 | Nicoloso | |
| 4,390,745 | A | | 6/1983 | Bottcher et al. | |
| 4,392,714 | A | | 7/1983 | Brüggendieck et al. | |
| 4,409,428 | A | | 10/1983 | Dey et al. | |
| 4,414,527 | A | | 11/1983 | Biller | |
| 4,440,975 | A | | 4/1984 | Kaczerginski | |
| 4,490,006 | A | | 12/1984 | Lidholt | |
| 4,491,687 | A | | 1/1985 | Kaczerginski et al. | |
| 4,495,381 | A | * | 1/1985 | Timoshenko et al. | 174/178 |
| 4,540,968 | A | | 9/1985 | Kato et al. | |
| 4,546,341 | A | | 10/1985 | McNaghten et al. | |
| 4,609,798 | A | | 9/1986 | Nicoloso | |
| 4,610,033 | A | | 9/1986 | Fox, Jr. | |
| 4,613,727 | A | | 9/1986 | Salanki et al. | |
| 4,653,846 | A | | 3/1987 | Yamazaki et al. | |
| 4,661,184 | A | | 4/1987 | Kläy | |
| 4,710,847 | A | | 12/1987 | Kortschinski et al. | |
| 4,714,800 | A | | 12/1987 | Atkins et al. | |
| 4,717,237 | A | | 1/1988 | Austin | |
| 4,772,090 | A | | 9/1988 | Atkins et al. | |
| 4,774,488 | A | | 9/1988 | Field | |
| 4,782,197 | A | * | 11/1988 | Stunzi et al. | 174/152 R |
| 4,802,731 | A | | 2/1989 | Maschek et al. | |
| 4,810,836 | A | | 3/1989 | Shinoda et al. | |
| 4,827,081 | A | | 5/1989 | Seabourne et al. | |
| 4,833,278 | A | | 5/1989 | Lambeth | |
| 4,864,455 | A | | 9/1989 | Shimomura et al. | |
| 4,870,387 | A | | 9/1989 | Harmon | |
| 4,909,428 | A | | 3/1990 | Mermet-Guyennet | |
| 4,919,217 | A | | 4/1990 | Mima et al. | |
| 4,921,322 | A | | 5/1990 | Seike et al. | |
| 4,945,333 | A | | 7/1990 | Stroud et al. | |
| 4,984,860 | A | | 1/1991 | Seike et al. | |

| | | | | | |
|---|---|---|---|---|---|
| 5,029,969 | A | | 7/1991 | Seike et al. | |
| 5,116,172 | A | | 5/1992 | Koster | |
| 5,128,648 | A | | 7/1992 | Brandi | |
| 5,136,680 | A | | 8/1992 | Seike et al. | |
| 5,159,158 | A | * | 10/1992 | Sakich et al. | 174/179 |
| 5,191,311 | A | | 3/1993 | Webb et al. | |
| 5,220,134 | A | | 6/1993 | Novel et al. | |
| 5,233,132 | A | | 8/1993 | Soucille | |
| 5,300,912 | A | | 4/1994 | Tillery et al. | |
| 5,374,780 | A | | 12/1994 | Pazdirek | |
| 5,374,789 | A | * | 12/1994 | Bernstorf | 174/188 |
| 5,389,742 | A | | 2/1995 | Clabburn et al. | |
| 5,406,033 | A | | 4/1995 | Pazdirek | |
| D360,399 | S | | 7/1995 | Tillery et al. | |
| 5,516,117 | A | | 5/1996 | Rangel | |
| 5,534,858 | A | | 7/1996 | Tinkham | |
| 5,540,991 | A | | 7/1996 | Hayakawa et al. | |
| 5,559,488 | A | | 9/1996 | Hassler et al. | |
| 5,563,379 | A | | 10/1996 | Kunieda et al. | |
| 5,594,827 | A | | 1/1997 | Joulie et al. | |
| 5,633,478 | A | | 5/1997 | Ishino | |
| 5,803,553 | A | | 9/1998 | Wei | |
| 5,877,453 | A | | 3/1999 | Hill | |
| 5,885,680 | A | | 3/1999 | Levillain et al. | |
| 5,921,591 | A | | 7/1999 | Argent | |
| 5,925,855 | A | | 7/1999 | Denndorfer | |
| 5,945,636 | A | | 8/1999 | Sakich et al. | |
| 5,973,272 | A | | 10/1999 | Levillain et al. | |
| 5,986,216 | A | * | 11/1999 | Krause | 174/179 |
| 6,031,186 | A | * | 2/2000 | Sakich et al. | 174/167 |
| 6,050,612 | A | | 4/2000 | Wolterman | |
| 6,065,207 | A | * | 5/2000 | Fujii et al. | 29/887 |
| 6,070,584 | A | | 6/2000 | Bergstrom | |
| 6,116,113 | A | | 9/2000 | Pazdirek et al. | |
| 6,318,686 | B1 | | 11/2001 | No | |
| 6,342,679 | B1 | * | 1/2002 | Portas et al. | 174/209 |
| 6,593,842 | B2 | | 7/2003 | Haynam et al. | |
| 6,702,975 | B1 | | 3/2004 | Windmar et al. | |
| 2002/0018745 | A1 | | 2/2002 | Herman | |
| 2002/0079703 | A1 | | 6/2002 | Barker, Jr. et al. | |

OTHER PUBLICATIONS

Thomas G. Gustavsson, Silicone Rubber Insulators—Impacts of material formulation in coastal environment, Apr. 2002, pp. 1–83, Göteborg, Sweden.

Instrument Transformers,Dec. 2000, pp. 1–12, ABB Switchgear AB.

Outdoor Instrument Transformers Buyer's Guide, Feb. 2003, pp. 1–60, ABB Power Technologies.

Silicone rubber in outdoor insulators, Sep. 1998, pp. 1–4, ABB Switchgear AB.

New ABB Factory Signals Long–Term Commitment to Hollow Composite Insulators, Insulator News and Market Reports, May/Jun. 1998, pp. 1–7.

Axicom® More than just a replacement for porcelain, undated, pp. 1–4, Axicom AG.

Composite Hollow Insulator Design Book, undated, pp. 1–7, Axicom.

Cevolit® components. Less weight. Greater Dependability, undated, pp. 1–4, Axicom AG.

* cited by examiner

COMPOSITE INSULATOR

FIELD OF THE INVENTION

This invention relates to composite insulators for electric power distribution systems.

BACKGROUND OF THE INVENTION

Insulators have been made with various materials. For example, insulators have been made of a ceramic or porcelain material. The ceramic and porcelain insulators, however, are heavy and bulky; they require specialized assembly fixtures or processes and are awkward and difficult to handle and ship. The ceramic insulators are brittle and easily chipped or broken.

As noted in application Ser. No. 10/173,386, filed on Jun. 16, 2002, entitled "Composite Insulator for Fuse Cutout," the disclosure of which is incorporated herein by reference, problems have arisen with electrical insulators. One such problem occurs when electricity flashes directly from a conducting surface to a grounded surface. This phenomenon is referred to as "flashover." The electricity travel gap between the conducting surface and the grounded surface is called the "strike distance."

Another problem occurs when the electrical current travels or "creeps" along the surface of the insulator. "Creep" results when the insulator has an inadequate surface distance. This may occur when water, dirt, debris, salts, airborne material, and air pollution is trapped at the insulator surface and provide an easier path for the electrical current. This surface distance may also be referred to as the "leakage," "tracking," or "creep" distance.

Because of these problems, insulators must be made of many different sizes so as to provide different strike and creep distances, as determined by operating voltages and environmental conditions. The strike distance in air is known, thus insulators must be made of various sizes in order to increase this distance and match the appropriate size insulator to a particular voltage. Creep distance must also be increased as voltage across the conductor increases so that flashover can be prevented.

Plastic or polymeric insulators have been designed to overcome some of the problems with conventional insulators. However, none of the prior plastic insulators have solved some or all of the problems simultaneously. For example, polymeric insulators have been made with "fins" or "sheds" which require time and labor for assembly. U.S. Pat. No. 4,833,278 to Lambeth, entitled "Insulator Housing Made From Polymeric Materials and Having Spirally Arranged Inner Sheds and Water Sheds," the disclosure of which is hereby incorporated herein by reference, discloses a resin bonded fiber tube made through filament winding (Col 5, ll. 15–17) with spiral ribs of fiberglass and resin to support a series of circular "sheds" (Col. 5, ll. 28–31; see also FIG. 1).

Other insulators require a complicated assembly of metal end fittings. For example, an electrical insulator is disclosed in U.S. Pat. No. 4,440,975 to Kaczerginski, entitled "Electrical Insulator Including a Molded One-Piece Cover Having Plate-like Fins with Arcuately Displaced Mold Line Segments," the disclosure of which is incorporated herein by reference. However, the insulator of Kaczerginski involves a more complicated assembly of two end pieces and an insulating rod of an undisclosed material. Col. 1, ll. 66–68. Similarly, in U.S. Pat. No. 4,246,696 to Bauer et al., the disclosure of which is incorporated herein by reference, an insulator having a prefabricated glass fiber rod manufactured through a pultrusion process is disclosed. Col. 3, ll. 47–49. Yet, the insulator of Bauer et al. requires a complicated attachment of metallic suspension fittings by fanning out the fiber reinforced stalk or by forcing the fittings on by pressure. Col. 3, line 67 to Col. 4, line 2.

Therefore, there exists a need for simple design that facilitates ease in the manufacture of the many different-sized cutouts and insulators the electrical power industry requires. There also exists a need for a lighter insulator that allows for greater ease in handling and shipping. Further, there exists a need for an insulator, which will not trap water, dirt, debris, salts, and air-borne material and thereby reduce the effective creep distance. Finally, there exists a need for a stronger insulator, which will not chip or break during shipping and handling.

The present invention is directed to overcoming these and other disadvantages inherent in prior-art systems.

SUMMARY OF THE INVENTION

The scope of the present invention is defined solely by the appended claims, and is not affected to any degree by the statements within this summary. Briefly stated, a composite insulator embodying features of the present invention comprises (i) a composite body having at least two connectors, wherein the composite body is coupled to a conductor; and (ii) a housing, wherein the housing is a one-piece housing and the composite body is located inside the housing.

DETAILED DESCRIPTION OF THE PRESENTLY PREFERRED EMBODIMENT

Figure 1:
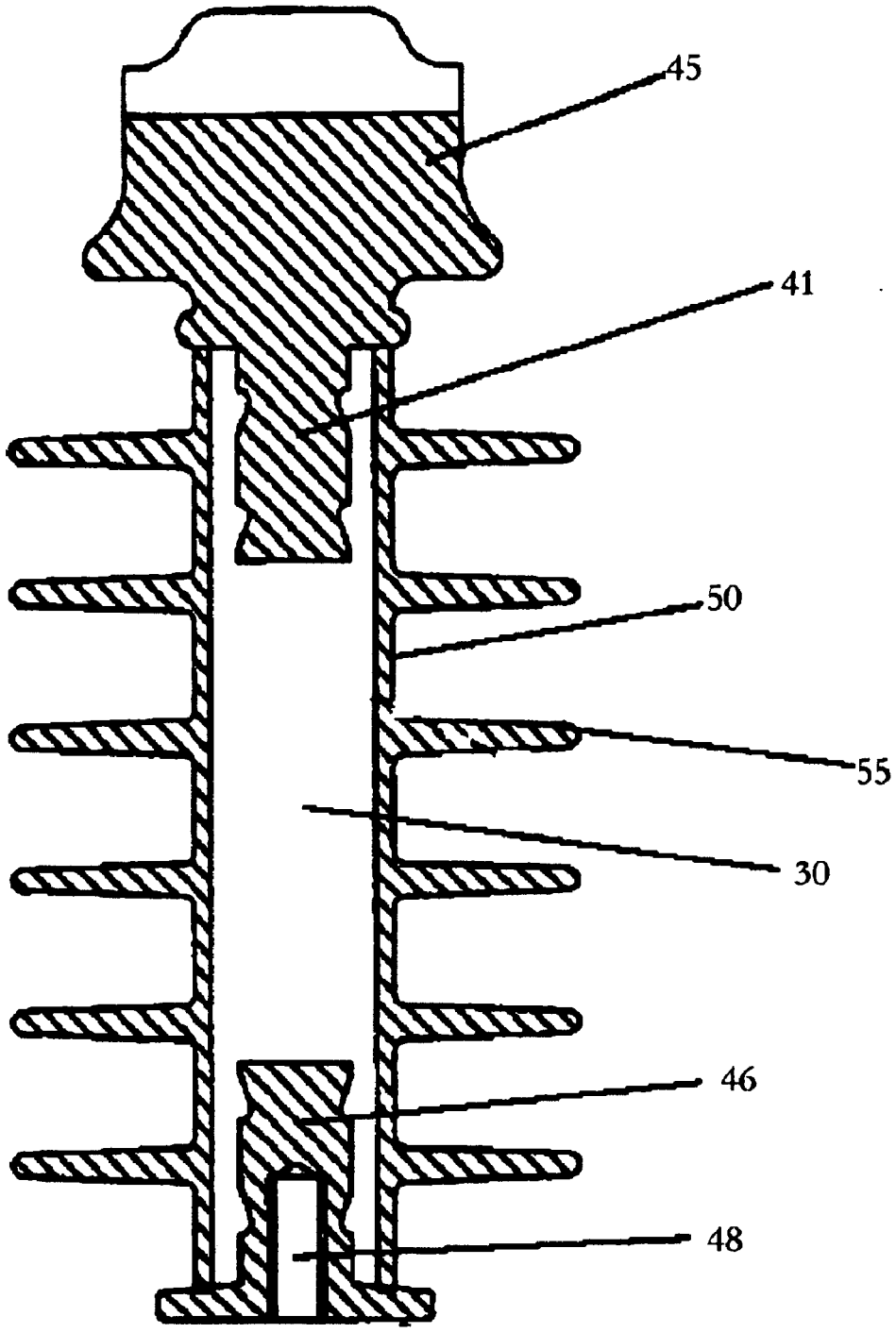
FIG. 1 depicts a cross-sectional view of an embodiment of a composite insulator with an F-neck and a tapped stud base as connectors.
Figure 2:
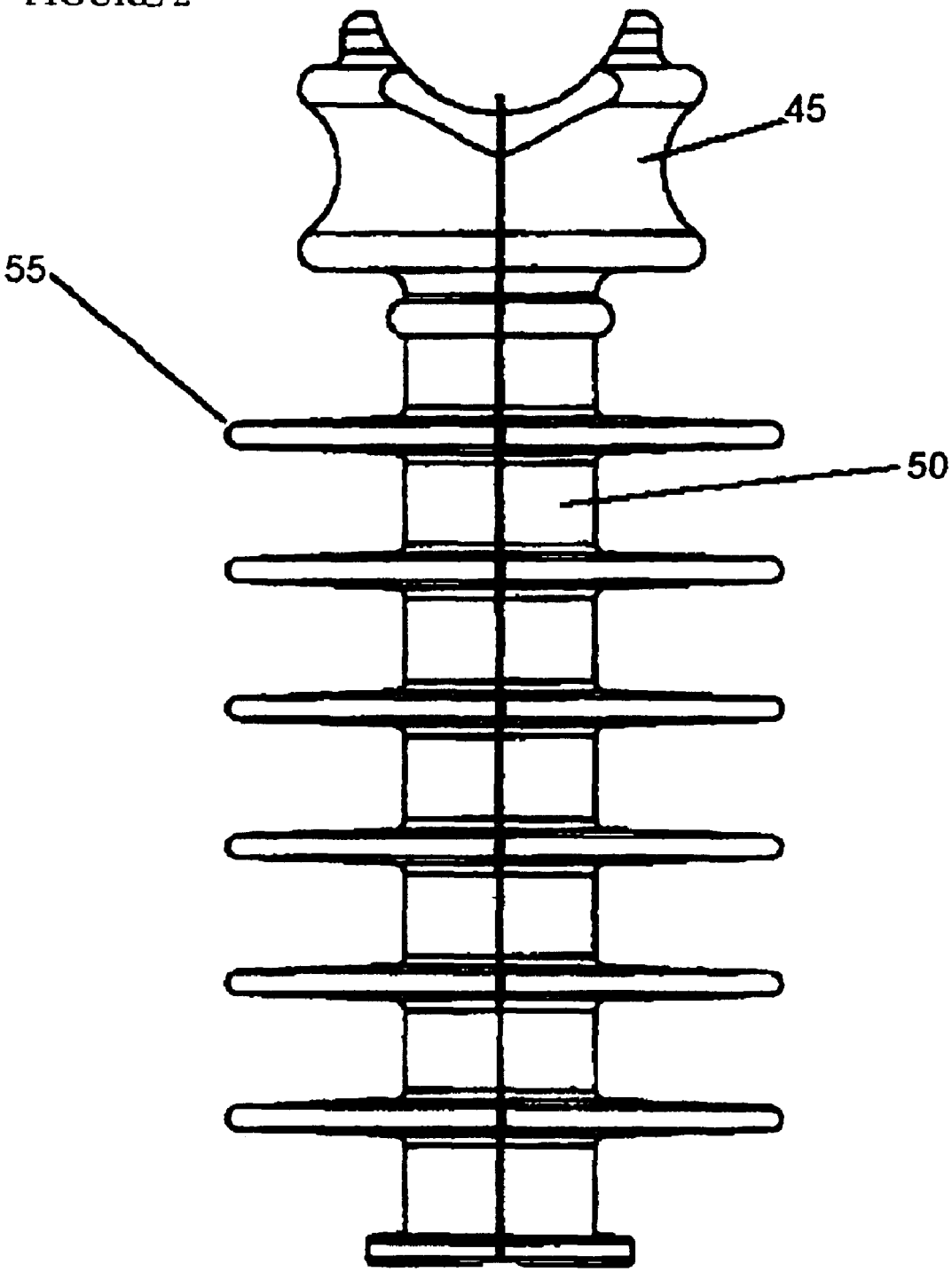
FIG. 2 depicts a view of the outside of an embodiment of a composite insulator with an F-neck and a tapped stud base as connectors.
Figure 3:
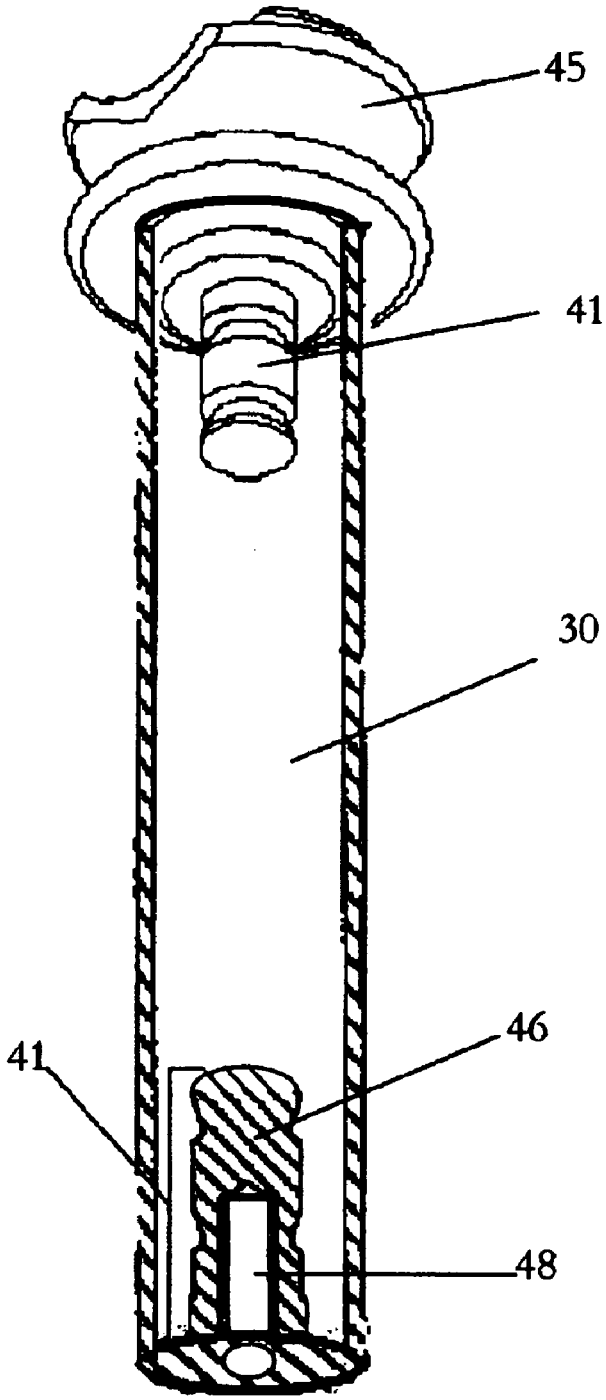
FIG. 3 depicts a cross sectional view of an embodiment of a body for a composite insulator with an F-neck and a tapped stud base as connectors.

The drawings show various embodiments of an insulator according to the present invention. FIGS. 1, 2, and 3 constitute a preferred embodiment of the present invention, comprising an insulator having a body 30 with a plurality of connectors and a housing 50.

The preferred embodiment of the present invention is provided with a plurality of connectors. According to one aspect of the present invention, the connector is a support connector that supports the body 30 when it is mounted on a utility structure, such as a utility pole or cross arm. According to another aspect of the present invention, the connector is one of a plurality of end connectors that couple the body 30 to a conductor. According to yet another aspect of the present invention, the connector couples the body 30 to ground.

Figure 5:
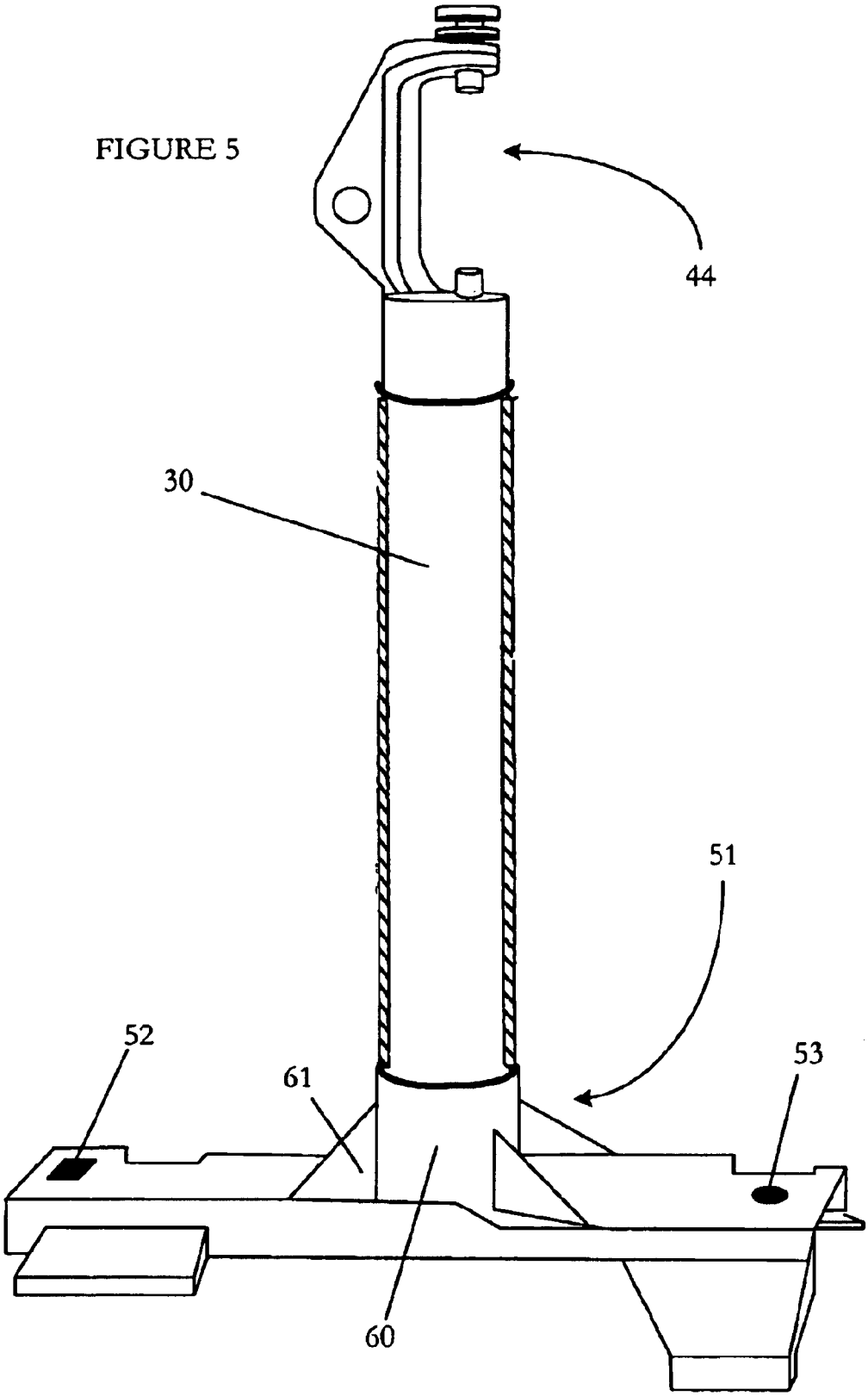
FIG. 5 depicts an embodiment of a body for a composite insulator with a "C" shaped connector and a bracket.
Figure 6:
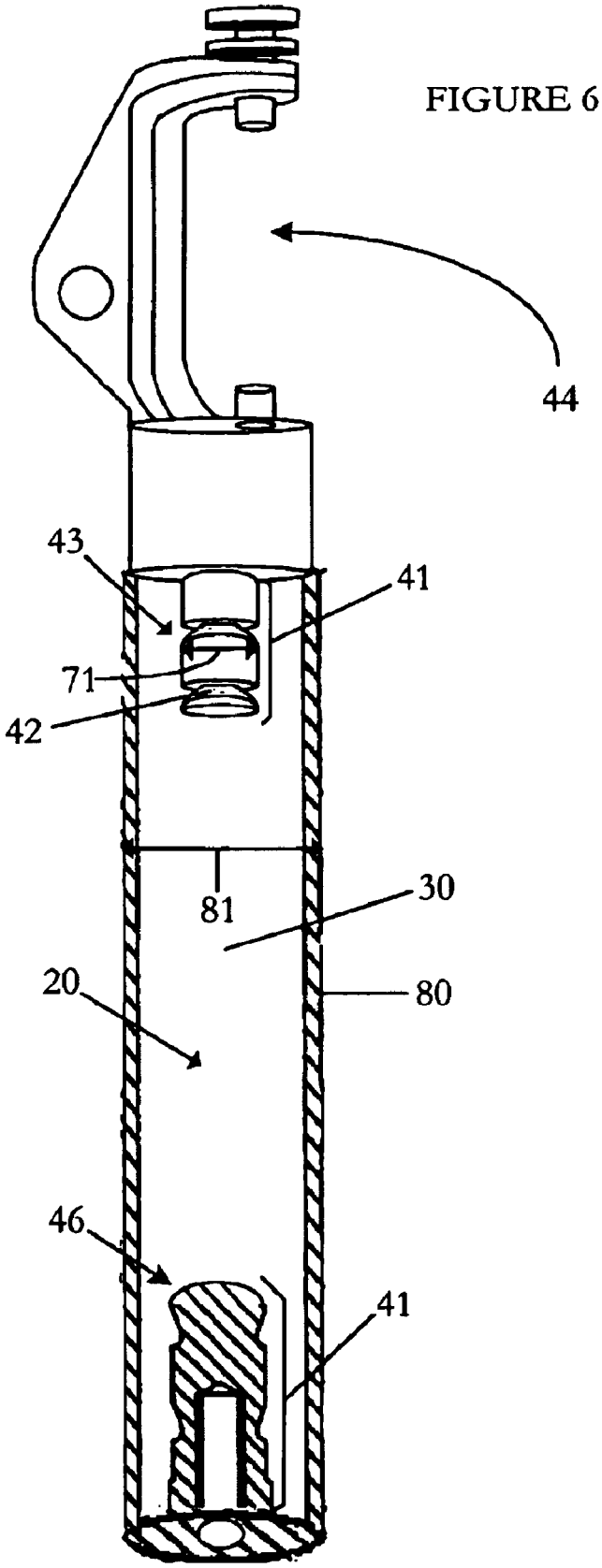
FIG. 6 depicts cross-sectional view of an embodiment of a body for a composite insulator with a "C" shaped connector and a tapped stud base connector.
Figure 7:
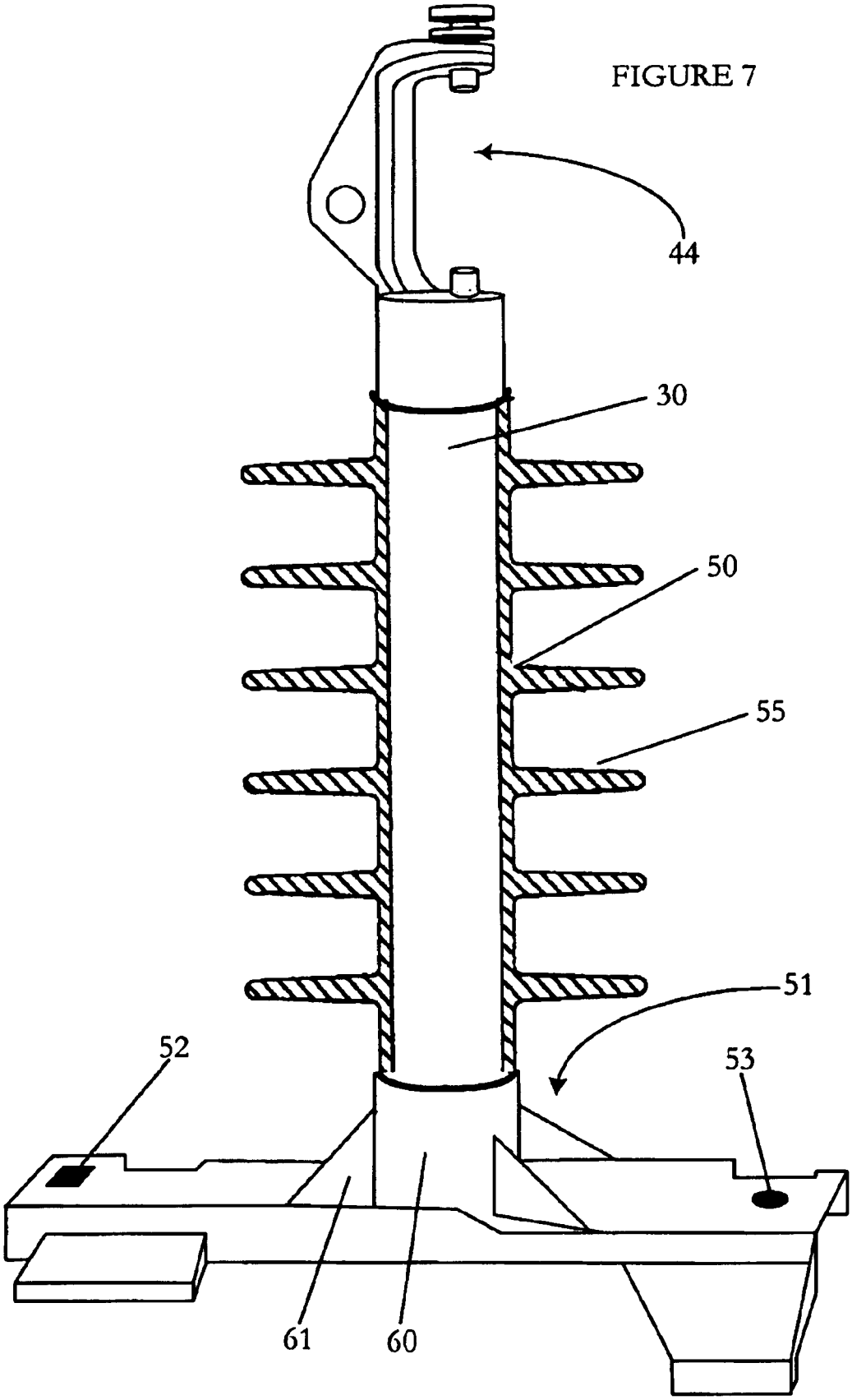
FIG. 7 depicts an embodiment of a composite insulator with a "C" shaped connector and a bracket.

Those skilled in the art will appreciate that the body 30 can be coupled to a conductor via a number of end connector configurations. FIGS. 5, 6, and 7 depict end connector 44 configured in the shape of a "C." FIGS. 1, 2, and 3 depict an end connector 45 with a configuration known in the art as an "F-Neck." FIGS. 8 and 9 depict an end connector 47 configured in the shape of a "U."

Figure 8:
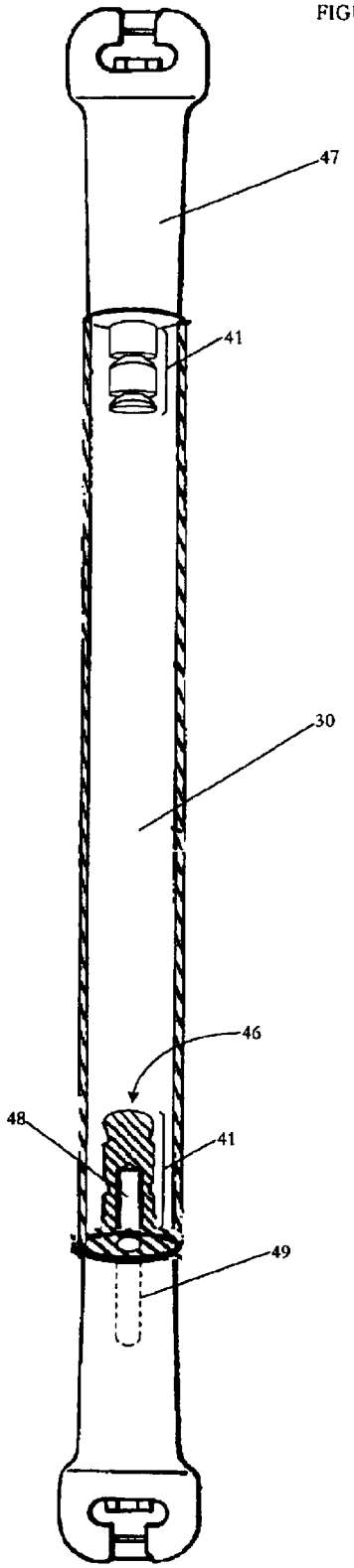
FIG. 8 depicts a cross-sectional view of an embodiment of a body for a composite insulator with a "U" shaped connector configured to work with a tapped stud base.
Figure 9:
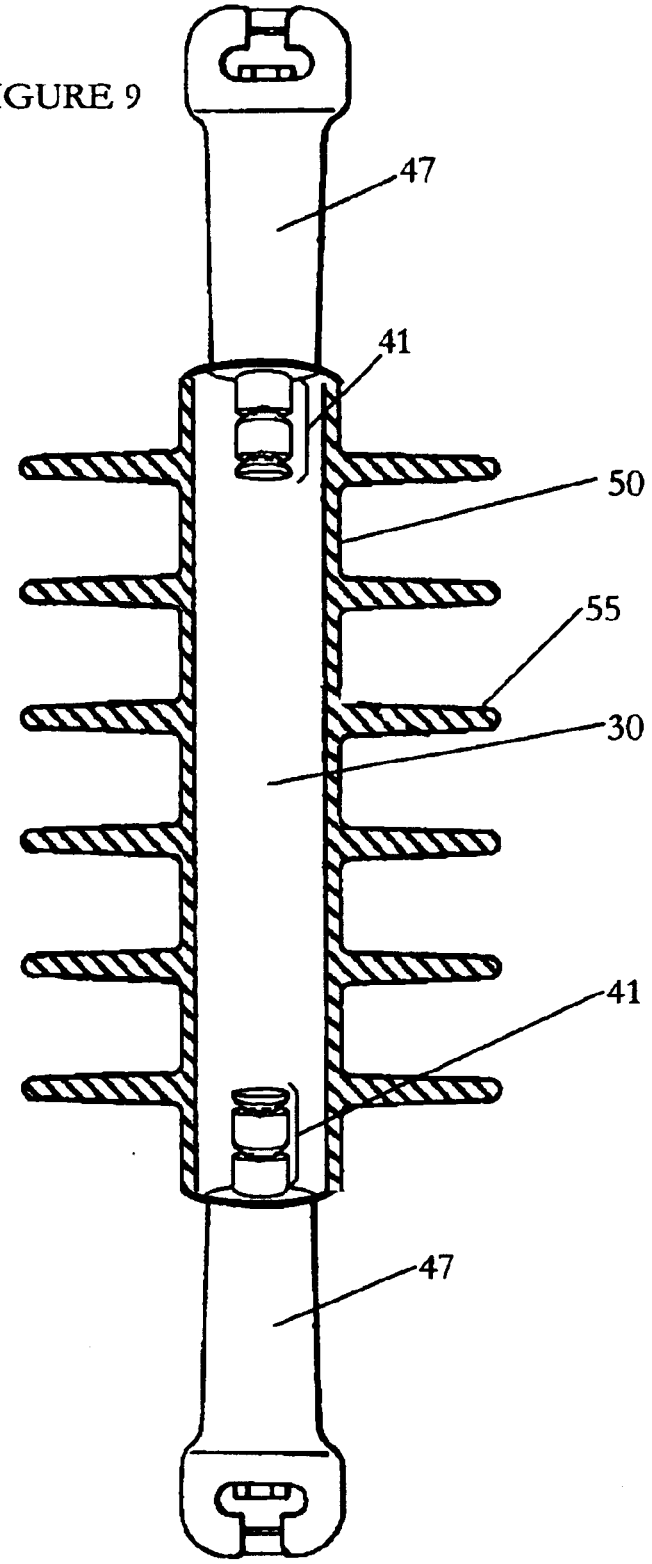
FIG. 9 depicts a cross-sectional view of an embodiment of a composite insulator with "U" shaped connectors.

FIGS. 3, 6, and 8 depict a tapped stud base 46 that includes a stud-receiving cavity 49; those skilled in the art will appreciate that the body 30 can be coupled to a conductor via any end connector configured to work with a stud 49. FIG. 8 illustrates an end connector configured to work with a stud 49.

Those skilled in the art will appreciate that the body 30 can be coupled to a utility structure via a number of support connector configurations. FIG. 7 depicts a supporting connector in a configuration known in the art as a bracket 51. In this embodiment, the tapped stud base 46 configuration is employed to attach the bracket 51 to the body 30. However, support connectors can be attached to the body 30 through other means. Holes 52, 53 are defined within the bracket 51 through which studs (not shown) are placed to couple the body 30 to a utility structure, such as a utility pole or cross arm.

In the preferred embodiment of the present invention, the connectors are formed of metal. According to one aspect of the present invention, the connectors 44, 45, 46, 47 are steel. According to another aspect of the present invention, the connectors 44, 45, 46, 47 are aluminum. According to yet another aspect of the present invention, the connectors 44, 45, 46, 47 are a metal alloy. According to still another aspect of the present invention, the connectors 44, 45, 46, 47 are made of a composite material.

In the preferred embodiment, the connectors are formed. In one aspect of the present invention, the connectors 44, 45, 46, 47 are forged. In another aspect, the connectors 44, 45, 46, 47 are machined. In still another aspect of the present invention, the connectors 44, 45, 46, 47 are cast.

The connectors 44, 45, 46, 47 are provided with a plurality of surfaces. As illustrated in FIGS. 5 and 6, in the preferred embodiment of the present invention, at least one of the connectors 44, 45, 46, 47 has an anchoring surface 41. The anchoring surface 41 has a conical surface 42 with a ridge surface 43 that is ridged in shape. As shown therein, the ridge surface 43 is provided with the diameter 71 that is smaller than an outer diameter 81 of the body 30. The anchoring surface 41 of the preferred embodiment allows for retention of the connector within the body 30.

Figure 4:
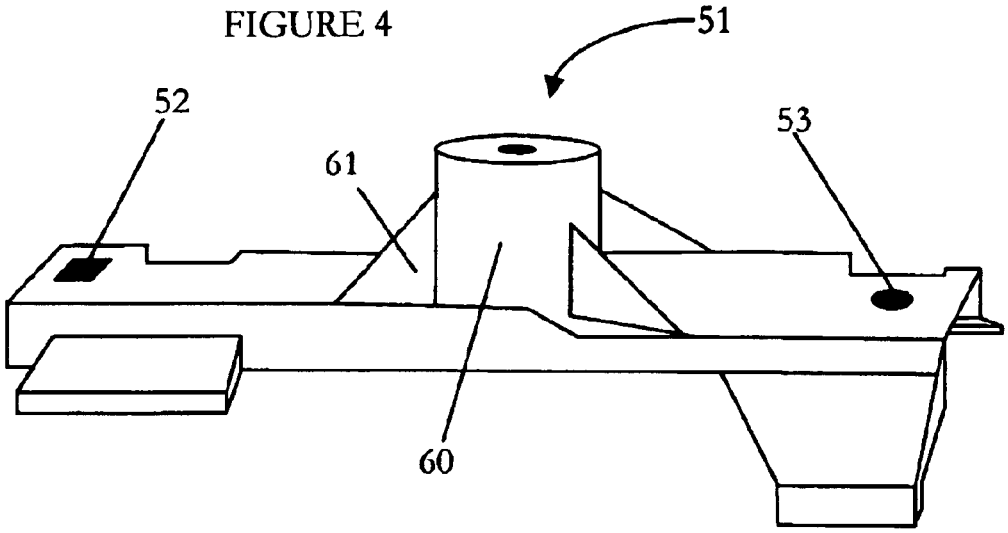
FIG. 4 depicts an embodiment of a bracket.

As depicted in FIGS. 4, 5, and 7, the connector 51 is provided with a generally cylindrical connector surface 60 and a plurality of projections 61. In the embodiment depicted, the projections 61 are generally triangular in shape and arranged radially from the generally cylindrical connector surface 60.

As illustrated in FIG. 8, the various connectors described herein can be used with one another. As illustrated in FIG. 8, a "U" shaped connector having an anchoring surface 41 can be used at one end of the body 30 while, at the other end, is a "U" shaped connector configured to work with a stud.

The end connectors of the present invention are not limited to the foregoing; so long as a connector serves at least the function of coupling the body 30 to a conductor, it is an end connector within the scope of the present invention. Furthermore, a supporting connector is not limited to the foregoing; as long as a connector serves at least the function of coupling the body 30 to a utility structure, it is a supporting connector within the scope of the present invention.

The body 30 is formed from a composite material. For the present invention, a composite material is any substance in the art that has electrically insulating properties, has sufficient rigidity to withstand the forces exerted by electric power lines, and is lighter per unit of volume than porcelain. The composite body of the preferred embodiment is made from materials which provide electrical insulating properties, preferably, a polymer. Other substances having electrically insulating properties may be used.

According to one aspect of the present invention, the composite material is a chemical compound, such as an organic compound, which is lighter per unit of volume than porcelain and composed of a single material. According to one aspect of the present invention, the composite material is a resin. According to another aspect of the present invention, the composite material is a polymer. According to another aspect of the present invention, the composite material is a plastic, such as thermoplastic or thermoset. According to yet another aspect of the present invention, the composite material is a polyester. According to still yet another aspect of the present invention, the composite material is an epoxy.

The composite material of the present invention is in a plurality of chemical combinations. According to one aspect of the present invention, the composite material is a mixture. According to another aspect of the present invention, the composite material is a mixture of a polymer and reinforcing materials.

The reinforcing material is in a plurality of shapes and configurations. According to one aspect of the present invention, the reinforcing material is in the shape of beads. In one embodiment, the reinforcing material is beads of glass. According to another aspect of the present invention, the reinforcing material is in a fibrous shape. In one embodiment of the present invention, the reinforcing material is glass fiber. Those skilled in the art will appreciate that the reinforcing material is composed of beads and fibers, and that any combination thereof can be used.

In one embodiment of the present invention, the reinforcing material is an insulating material such as glass. Those skilled in the art will appreciate that a composite material is a polymer mixed with glass. In another embodiment, the reinforcing material is an arimid. Those skilled in the art will also appreciate that a composite material is a polymer mixed with an aramid.

According to one aspect of the present invention, a composite material is a polymer mixed with polyester. According to another aspect of the present invention, the composite material is a polymer mixed with a resin. According to yet another aspect of the present invention, the composite material is a polymer mixed with a plastic. According to still another aspect of the present invention, the composite material is a polymer mixed with an epoxy.

The mixture is not limited to the above, and a composite material is not limited to the foregoing description. So long as the material is a substance that has electrically insulating properties, has sufficient rigidity to withstand the forces exerted by electric power lines, and is lighter per unit of volume than porcelain it is a composite material within the scope of the present invention.

As depicted in FIGS. 1, 2, 3, and 4, the body 30 of the preferred embodiment is made with connectors 44, 45, 46, 47. According to one aspect of the present invention, the body 30 is made through an injection molding process known as insert molding. The preferred embodiment is made through insert molding and the use of a mold in a plurality of pieces. According to another aspect of the present invention, the body 30 is made with connectors 44, 45, 46, 47 through transfer molding. According to another aspect of the present invention, the body 30 is made with connectors 44, 45, 46, 47 through compression molding. According to yet another aspect of the present invention, the body 30 is made with connectors 44, 45, 46, 47 through casting.

The body 30 is composed of a plurality of shapes. As shown in FIG. 6, the body 30 is a hollow tube that encloses a cavity 20. Also shown, the body 30 is provided with an outer surface 80 that includes a generally cylindrical shape and the outer diameter 81. Those skilled in the art will appreciate that the body 30 can be composed of a plurality of cylindrical shapes having a plurality of radii. According to another aspect of the present invention, the body 30 is composed of a plurality of conical shapes. Again, those skilled in the art will appreciate that the body 30 can be composed of conical shapes having a plurality of radii.

The connectors of the preferred embodiment are integrated into the body 30. In making the body 30 of the preferred embodiment through use of a two-piece mold, the anchoring surface 41 of the connectors 45, 46 are placed in the mold. After the connectors 45, 46 are placed in the mold, the mold is closed. After the mold is closed, composite material is injected into the mold. After the composite material is injected, the mold is removed. The body 30 is then placed into the housing 50.

FIG. 2 depicts the housing 50 of the preferred embodiment of the present invention. The housing 50 of the present invention is a structure that houses the body 30. In the preferred embodiment depicted in FIG. 2, the housing 50 is made of silicone rubber. According to another aspect of the present invention, the housing 50 is made of an elastomer. According to yet another aspect of the present invention, the housing 50 is made of rubber. In another aspect of the present invention, the housing 50 is made of EPDM. In yet another aspect of the present invention, the housing 50 is made of room temperature vulcanized rubber ("RTV rubber"). According to yet another aspect of the present invention, the housing 50 is made of an alloy of rubber and elastomer materials.

The housing 50 of the preferred embodiment is a made through an injection molding process known as insert molding thereby yielding a one-piece housing. According to one aspect of the present invention, insert molding is accomplished through use of a mold in a plurality of pieces. According to one aspect of the present invention, the housing 50 is made through transfer molding. According to another aspect of the present invention, the housing 50 is made through compression molding. According to yet another aspect of the present invention, the housing 50 is made through casting.

As depicted in FIGS. 1, 7, and 9, the body 30 is situated inside the housing 50. In the presently preferred embodiment, the housing 50 is insert-molded around the body 30. The body 30 of the preferred embodiment is inserted into a two-piece mold, which has been previously shaped with sheds 55; then, the mold is closed. To make the preferred embodiment depicted in FIG. 2, silicone rubber is injected into the mold so that the silicone rubber assumes the form of the housing 50 with sheds 55. In the preferred embodiment of the present invention, the sheds 55 increase the surface distance from one end of the housing 50 to the other.

While the housing 50 of the preferred embodiment is made through use of silicone rubber and a two-piece mold, other molds can be used. According to one aspect of the present invention, the mold is one piece. According to yet another aspect of the present invention, the mold is formed of a plurality of pieces. Those skilled in the art will appreciate that while the housing 50 of the preferred embodiment is formed from one mold, the housing of the present invention can be made with more than one mold.

The housing 50 of the present invention is not limited to the foregoing; so long as a structure houses the body 30, it is a housing within the scope of the present invention.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An insulator for electric power, comprising:

a. a body generally cylindrical in shape enclosing a cavity and containing a polymer and a glass fiber and further provided with a first end that includes a first connector retained thereon and a second end that includes a second connector retained thereon;

b. the first connector defines a plurality of holes for a stud and is provided with a generally cylindrical connector surface and a plurality of projections that are generally triangular in shape and arranged radially from the generally cylindrical connector surface;

c. the second connector is provided with an anchoring surface that is generally cylindrical in shape and includes a ridge surface that contacts the body and retains the second connector on the body; and d. a housing comprising a rubber that includes silicone and provided with a plurality of sheds that increase the surface distance from the first end of the body to the second end of the body, wherein the housing is molded onto the body and houses the body and at least a portion of at least one of the connectors.

2. An insulator according to claim 1, wherein the body includes an aramid.

3. An insulator according to claim 1, wherein the rubber is applied to and formed on the body.

4. An insulator according to claim 1, further comprising a structural relationship between the housing and the body, wherein the structural relationship is characterized by the rubber having flowed onto the body to assume the form of the housing.

5. An insulator according to claim 1, wherein at least one of the connectors is cast and machined and includes an aluminum.

6. An insulator according to claim 1, wherein the rubber is a vulcanized rubber.

7. An insulator according to claim 1, wherein the ridge surface is ridged in shape.

8. An insulator according to claim 1, wherein the body is provided with a plurality of cylindrical surfaces that include a plurality of radii.

9. An insulator according to claim 1, wherein the body is provided with a plurality of cylindrical surfaces and a plurality of conical surfaces that include a plurality of radii.

10. An insulator according to claim 1, wherein the body is provided with a conical surface.

11. An insulator according to claim 1, wherein the housing includes EPDM.

12. An insulator according to claim 1, wherein the housing includes RTV rubber.

13. An insulator for electric power, comprising:

a. a body generally cylindrical in shape comprising a hollow tube and containing a polymer that includes an epoxy, a glass, and an aramid, and further provided with a first end that includes a first connector retained thereon and a second end that includes a second connector retained thereon;

b. the first connector defines a plurality of holes for a stud and is provided with a generally cylindrical connector surface and a plurality of projections that are arranged radially from the generally cylindrical connector surface;

c. the second connector is provided with an anchoring surface that is generally cylindrical in shape and includes a ridge surface that contacts the body and retains the second connector on the body; and d. a housing comprising a silicone rubber provided with a plurality of sheds that increase the surface distance from the first end of the body to the second end of the body, wherein the housing is molded onto the body and houses the body and at least a portion of at least one of the connectors.

14. An insulator according to claim 13, wherein the silicone rubber is applied to and formed on the body.

15. An insulator according to claim 13, further comprising a structural relationship between the housing and the body, wherein the structural relationship is characterized by the silicone rubber having flowed onto the body to assume the form of the housing.

16. An insulator according to claim 13, wherein at least one of the connectors is cast and machined and includes an aluminum.

17. An insulator according to claim 13, wherein the ridge surface is ridged in shape.

18. An insulator according to claim 13, wherein the body is provided with a plurality of cylindrical surfaces that include a plurality of radii.

19. An insulator according to claim 13, wherein the body is provided with a plurality of cylindrical surfaces and a plurality of conical surfaces that include a plurality of radii.

20. An insulator according to claim 13, wherein the body is provided with a conical surface.

21. An insulator for electric power, comprising:

a. a body provided with a first end that includes a first connector retained thereon and a second end that includes a second connector retained thereon, the body containing a polymer that includes an epoxy and a glass and including an outer surface that is generally cylindrical in shape and provided with an outer diameter;

b. the first connector defines a plurality of holes for a stud and is provided with a generally cylindrical connector surface and a plurality of projections that are arranged radially from the generally cylindrical connector surface;

c. the second connector is provided with a generally cylindrical anchoring surface that contacts the body so that the second connector is retained on the body, the second connector further includes a ridge surface that is provided with a diameter that is smaller than the outer diameter of the body; and d. a housing comprising a silicone rubber provided with a plurality of sheds that increase the surface distance from the first end of the body to the second end of the body, wherein the housing is molded onto the body and houses the body and at least a portion of at least one of the connectors.

22. An insulator according to claim 21, wherein the body includes an aramid.

23. An insulator according to claim 21, wherein the silicone rubber is applied to and formed on the body.

24. An insulator according to claim 21, further comprising a structural relationship between the housing and the body, wherein the structural relationship is characterized by the silicone rubber having flowed onto the body to assume the form of the housing.

25. An insulator according to claim 21, wherein at least one of the connectors is cast and machined and includes an aluminum.

26. An insulator according to claim 21, wherein the ridge surface is ridged in shape.

27. An insulator according to claim 21, wherein the body is provided with a plurality of cylindrical surfaces that include a plurality of radii.

28. An insulator according to claim 21, wherein the body is provided with a plurality of cylindrical surfaces and a plurality of conical surfaces that include a plurality of radii.

29. An insulator according to claim 21, wherein the body is provided with a conical surface.

30. An insulator for electric power, comprising:

a. a body provided with a first end that includes a first connector retained thereon and a second end that includes a second connector retained thereon, the body containing a polymer that includes an epoxy and a glass and including an outer surface that is generally cylindrical in shape and provided with an outer diameter;

b. the first connector is a support connector that defines a plurality of holes for a stud so that the body is configured to be attached utility structure and is further provided with an anchoring surface that retains the first connector on the body;

c. the second connector includes an anchoring surface that is generally cylindrical, contacts the body so that the second connector is retained on the body, and includes a ridge surface that is ridged in shape; and d. a housing comprising a silicone rubber provided with a plurality of sheds that increase the surface distance from the first end of the body to the second end of the body, wherein the housing is molded onto the body and houses the body and at least a portion of at least one of the connectors.

31. An insulator according to claim 30, wherein the body includes an aramid.

32. An insulator according to claim 30, wherein the silicone rubber is applied to and formed on the body.

33. An insulator according to claim 30, further comprising a structural relationship between the housing and the body, wherein the structural relationship is characterized by the silicone rubber having flowed onto the body to assume the form of the housing.

34. An insulator according to claim 30, wherein at least one of the connectors is cast and machined and includes an aluminum.

35. An insulator according to claim 30, wherein the body is provided with a plurality of cylindrical surfaces that include a plurality of radii.

36. An insulator according to claim 30, wherein the body is provided with a plurality of cylindrical surfaces and a plurality of conical surfaces that include a plurality of radii.

37. An insulator according to claim 30, wherein the body is provided with a conical surface.

38. An insulator for electric power, comprising:

a. a body provided with a first end that includes a first connector retained thereon and a second end that includes a second connector retained thereon, the body containing a polymer that includes an aramid and including an outer surface that is generally cylindrical in shape and provided with an outer diameter;

b. the first connector is a support connector that defines a plurality of holes for a said so that the body is configured to be attached utility structure and is further provided with an anchoring surface that retains the first connector on the body;

c. the second connector includes an anchoring surface that is generally cylindrical, contacts the body so that the second connector is retained on the body, and includes a ridge surface that is ridged in shape; and d. a housing comprising a silicone rubber provided with a plurality of sheds that increase the surface distance from the first end of the body to the second end of the body, wherein the housing is molded onto the body and houses the body and at least a portion of at least one of the connectors.

39. An insulator according to claim 38, wherein the silicone rubber is applied to and formed on the body.

40. An insulator according to claim 38, further comprising a structural relationship between the housing and the body, wherein the structural relationship is characterized by the silicone rubber having flowed onto the body to assume the form of the housing.

41. An insulator according to claim 38, wherein at least one of the connectors is cast and machined and includes an aluminum.

42. An insulator according to claim 38, wherein the body is provided with a plurality of cylindrical surfaces that include a plurality of radii.

43. An insulator according to claim 38, wherein the body is provided with a plurality of cylindrical surfaces and a plurality of conical surfaces that include a plurality of radii.

44. An insulator according to claim 38, wherein the body is provided with a conical surface.

45. An insulator according to claim 38, wherein the first connector is provided with a generally cylindrical connector surface and a plurality of projections that are arranged radially from the generally cylindrical connector surface.

46. An insulator for electric power, comprising:

a. a body provided with a first end that includes a first connector retained thereon and a second end that includes a second connector retained thereon, the body containing a polymer that includes a polyester and including an outer surface that is generally cylindrical in shape and provided with an outer diameter;

b. the first connector is a support connector that defines a plurality of holes for a stud so that the body is configured to be attached utility structure and is further provided with an anchoring surface that retains the first connector on the body;

c. the second connector includes an anchoring surface that is generally cylindrical, contacts the body so that the second connector is retained on the body, and includes a ridge surface that is ridged in shape; and d. a housing comprising a silicone rubber provided with a plurality of sheds that increase the surface distance from the first end of the body to the second end of the body, wherein the housing is molded onto the body and houses the body and at least a portion of at least one of the connectors.

47. An insulator according to claim 46, wherein the silicone rubber is applied to and formed on the body.

48. An insulator according to claim 46, further comprising a structural relationship between the housing and the body, wherein the structural relationship is characterized by the silicone rubber having flowed onto the body to assume the form of the housing.

49. An insulator according to claim 46, wherein at least one of the connectors is cast and machined and includes an aluminum.

50. An insulator according to claim 46, wherein the body is provided with a plurality of cylindrical surfaces that include a plurality of radii.

51. An insulator according to claim 46, wherein the body is provided with a plurality of cylindrical surfaces and a plurality of conical surfaces that include a plurality of radii.

52. An insulator according to claim 46, wherein the body is provided with a conical surface.

53. An insulator according to claim 46, wherein the first connector is provided with a generally cylindrical connector surface and a plurality of projections that are arranged radially from the generally cylindrical connector surface.

* * * * *